United States Patent [19]

Sarcia

[11] 4,305,741

[45] Dec. 15, 1981

[54] CRYOGENIC APPARATUS

[75] Inventor: Domenico S. Sarcia, Carlisle, Mass.

[73] Assignee: Oerlikon-Buhrle U.S.A. Inc., New York, N.Y.

[21] Appl. No.: 89,274

[22] Filed: Oct. 29, 1979

[51] Int. Cl.[3] ..... F25B 9/00

[52] U.S. Cl. ..... 62/6; 137/625.37

[58] Field of Search ..... 62/6; 137/625.34, 625.35, 137/625.37, 625.38

[56] References Cited

U.S. PATENT DOCUMENTS

| | | | |
|---|---|---|---|
| 2,906,101 | 9/1959 | McMahon et al. | 62/6 |
| 2,966,035 | 12/1960 | Gifford | 62/6 |
| 3,119,237 | 1/1964 | Gifford | 62/6 |
| 3,188,821 | 6/1965 | Chellis | 62/6 |
| 3,218,815 | 11/1965 | Chellis et al. | 62/6 |
| 3,421,331 | 1/1969 | Webb | 62/6 |
| 3,600,903 | 8/1971 | Chellis | 62/6 |
| 3,609,982 | 10/1971 | O'Neil et al. | 62/6 |
| 3,620,029 | 11/1971 | Longsworth | 62/6 |
| 3,733,837 | 5/1973 | Lobb | 62/6 |
| 3,788,088 | 1/1974 | Dehne | 62/6 |
| 3,853,146 | 12/1974 | Blair | 137/625.37 |
| 4,108,210 | 8/1978 | Luthe et al. | 137/625.37 |

*Primary Examiner*—Ronald C. Capossela

*Attorney, Agent, or Firm*—Schiller & Pandiscio

[57] ABSTRACT

A self-regulating cryogenic refrigerator is disclosed which features a displacer and novel refrigerant flow control means comprising a slide valve which is movable by the displacer and coacts therewith to control movement of refrigerant into and out of a chamber whose volume varies with movement of the displacer.

39 Claims, 10 Drawing Figures

CRYOGENIC APPARATUS

This invention relates to cryogenic refrigeration and more specifically to improvements in the methods and equipments employed for producing refrigeration at relatively low temperatures (110° K.–14° K.).

BACKGROUND OF THE INVENTION

A number of unique refrigeration cycles and apparatus have been developed to satisfy the increasing demand for highly reliable, long-lasting cryogenic refrigerators for use in such diverse fields as electronic communications systems, missile tracking systems, super conducting circuitry, high field strength magnets, and medical and biology laboratories for preparation of tissue samples and freezing of solutions. These refrigeration cycles and apparatus, all based upon the controlled cycling of an expansible fluid with suitable heat exchange to obtain refrigeration, are exemplified by U.S. Pat. Nos. 2,906,101, 2,966,034, 2,966,035, 3,045,436, 3,115,015, 3,115,016, 3,119,237, 3,148,512, 3,188,819, 3,188,820, 3,188,821, 3,218,815, 3,333,433, 3,274,786, 3,321,926, 3,625,015, 3,733,837, 3,884,259, 4,078,389 and 4,118,943, and the prior art cited in the foregoing patents.

The present invention is directed at refrigeration systems which employ a working volume defined by a vessel having a displacer therein with a regenerator coupled between opposite ends of the vessel so that when the displacer is moved toward one end of the vessel, refrigerant fluid therein is driven through the regenerator to the opposite end of the vessel. Such systems may take various forms and employ various cycles, including the well known Gifford-McMahon, Taylor, Solvay and Split Stirling cycles. These refrigeration cycles and apparatus require valves or pistons for controlling the flow and movement of working fluid and the movement of the displacer means. The fluid flow and the displacer movement must be controlled continuously and accurately so that the system can operate according to a predetermined timing sequence as required by the particular refrigeration cycle for which the system is designed. Although a fixed timing sequence is the usual objective, it also is desirable to be able to alter the sequence in certain respects, e.g., the time over which high pressure fluid is introduced to the vessel or the time period during which expansion and cooling are achieved.

Heretofore the valving of cryogenic equipment of the type described has taken various forms, but inevitably the valving or the resulting refrigerator has sufferend from one or more of the following limitations: complexity of construction, relatively high cost of manufacture, difficulty of modification as to timing sequence, relatively short operating life, poor reliability, difficulty of adjustment after assembly, and small range of refrigeration capacities. The problem of complexity in construction has been especially great where there have been attempts to achieve self-regulating valve systems. Additional specific problems that have plagued prior cryogenic equipment have been disintegration of lead shot in the regenerator section due to the "slamming" or "banging" of the displacer on its mechanical stops each time it undergoes direction reversal, excessive size of the valving (or of the refrigerator because of the valving construction and/or location), the criticality or short life of seals between certain moving parts, reduced efficiency due to excessive work input or work absorption (e.g. high friction losses), and inability to operate at the low reciprocating speeds that are preferred for such apparatus. Among the several types of valve systems that have been employed are rotary valves as exemplified by U.S. Pat. Nos. 3,119,237, 3,625,015, fluid actuated valves as shown in U.S. Pat. No. 3,321,926, cam operated valves as disclosed by U.S. Pat. No. 2,966,035, mechanically actuated slide valves as shown in U.S. Pat. No. 3,188,821, and displacer-operated valves as shown in U.S. Pat. No. 3,733,837.

U.S. Pat. No. 3,733,837 discloses refrigerators in which cooling of a gas is achieved by expanding it in an expansion chamber, with gas flow to and from the expansion chamber being controlled by a valve having a slidable member operated by the displacer. The refrigerators are self-regulating in the sense that movement of the slidable valve member is controlled by the displacer and movement of the displacer is caused by a gas pressure differential determined by the position of the valve member. The refrigerators disclosed in U.S. Pat. No. 3,733,837 have a number of limitations. First of all the slide valves result in a relatively large void volume which is always filled with gas. Since the gas in the void volume is not cooled, the device has an efficiency limitation. The void volume can be reduced by reducing the diameter of the upper end of the displacer, but since that reduces the effective area it creates the adverse effect of reducing the pneumatic driving force on the displacer. On the other hand increasing the diameter of the upper end of the displacer, as may be desirable for larger capacity refrigerators, is troublesome since that cannot be done without proportionately increasing the overall size of the slide valve. Secondly the fixed portion of the valve is located outside of the refrigeration cylinder while the movable valve member is located inside of the cylinder. Hence the valve does not lend itself to being preassembled as a discrete unit with precision-fitted parts. Still another limitation is that the reciprocating speed of the displacer cannot be varied easily and quickly.

OBJECTS AND SUMMARY OF THE INVENTION

It is therefore the primary object of this invention to provide a cryogenic apparatus characterized by a valve mechanism which not only is relatively simple and inexpensive to manufacture, but also allows the apparatus to be made in different sizes and makes possible an improved refrigeration cycle.

It is another object to provide cryogenic apparatus of the character described in which the valving mechanism may be easily removed for inspection and possible replacement.

Still another object of the invention is to provide an improved cryogenic refrigerator which is arranged and operated so that the direction of gas flow (injecting or exhausting) is reversed only when the displacer is substantially at the end of its upward or downward stroke, thereby assuring maximum gas volume transfer through the regenerator and consequently better refrigeration efficiency.

Still a further object of the invention is to provide a self-regulating cryogenic refrigerator with a flow control slide valve which is designed to assure movement of the displacer with a consequent displacement of fluid in accordance with a predetermined refrigeration cycle.

Still another object of the invention is to provide a cryogenic refrigerator comprising valving means for controlling the flow of refrigerant characterized by a lost-motion connection between the reciprocal valve member and the reciprocal displacer.

The apparatus of this invention comprises cylinder means, displacer means movable within the cylinder means, first and second chambers the volumes of which are modified by the movement of the displacer means, conduit means connecting the first and second chambers and thermal storage means associated with the conduit means, and refrigerant flow control valve means for injecting high pressure fluid to and removing low pressure fluid from the first chamber with the pressure differential across the displacer means being varied cyclically so as to impart a predetermined motion to the displacer which consists of four steps in sequence as follows: dwelling in an uppermost position, moving downwardly, dwelling in a lowermost position, and moving upwardly. The valve means comprises a reciprocable valve member with passageways for conducting fluid to and from the first chamber according to the position of the valve member, and is operated so that high pressure fluid enters the first chamber and the conduit during the first and second steps of the displacer motion and low pressure fluid is exhausted from the first chamber during the third and fourth steps of the displacer motion. The flow control valve means is operated by the displacer means as the latter approaches its uppermost and lowermost positions and is adapted to vary the pressure in both the first and second chambers so as to provide the required cyclically-varying pressure differential. The refrigeration equipment may consist of a single refrigeration stage or two or more stages connected in series in the manner disclosed by U.S. Pat. Nos. 3,188,818 and 3,218,815. Additionally the system may include auxiliary refrigeration stages employing one or more Joule-Thomson heat exchangers and expansion valves as disclosed by U.S. Pat. No. 3,415,077.

BRIEF DESCRIPTION OF THE DRAWINGS

Other features and many of the attendant advantages of the invention are described or rendered obvious by the following description and the accompanying drawings in which the same reference characters are used to refer to the same parts throughout the different views. The drawings are not necessarily to scale, emphasis instead being placed upon illustrating principles of the invention in a clear manner.

DESCRIPTION OF THE SEVERAL EMBODIMENTS OF THE INVENTION

In the following detailed description of the several embodiments of the invention, reference will be made from time to time to upper and lower sections. The terms "upper" and "lower" are used in a relative sense and it is to be understood that the refrigeration apparatus may be oriented in any manner. Hence, the terms "upper" and "lower" are employed in this description only to correspond to the orientation illustrated in the figures. Also, although helium gas is the preferred working fluid, it is to be understood that the present invention may be practiced with other gases according to the refrigeration temperatures that may be desired, including but not limited to, air and nitrogen.

Figure 1:
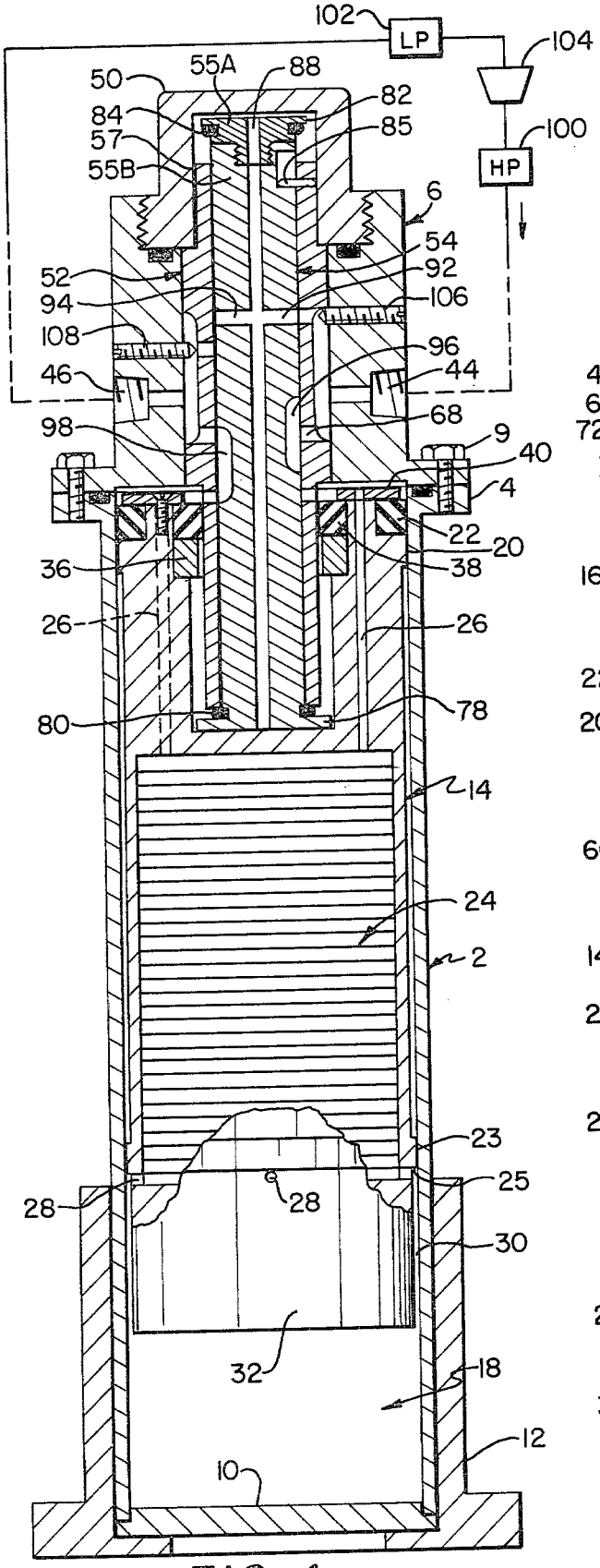
FIG. 1 is an enlarged, partially sectional view, of one embodiment of the invention constituting a self-regulating Gifford-McMahon cycle cryogenic refrigerator, showing the displacer and valve mechanism in a first selected position.
Figure 2:
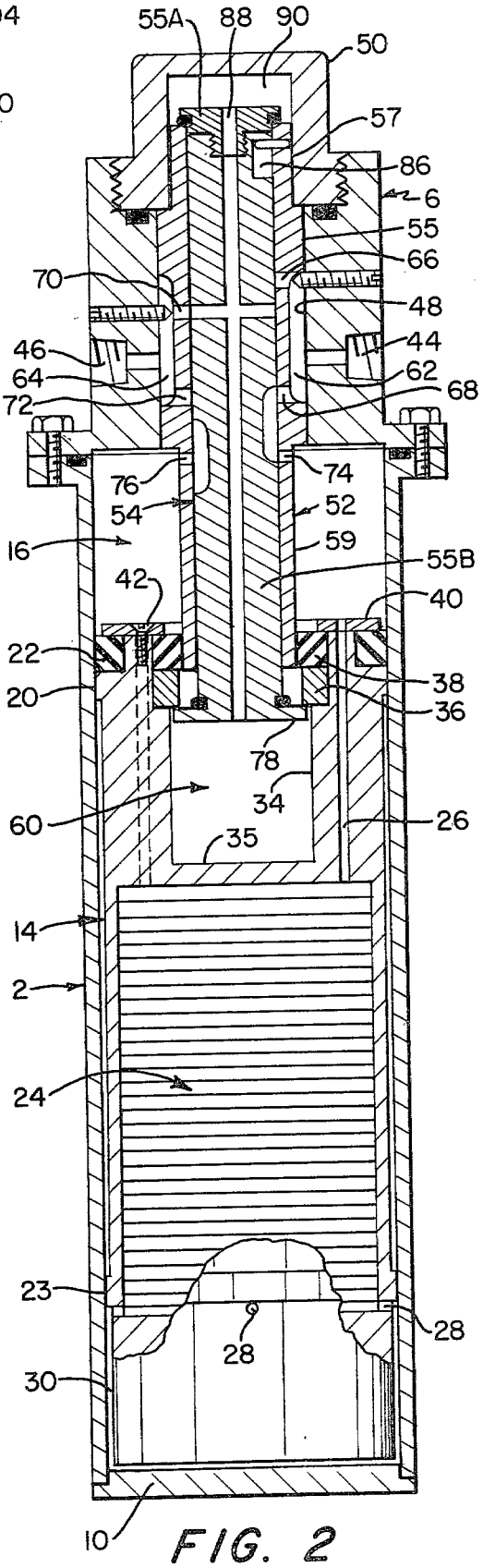
FIGS. 2 and 3 are schematic sectional views similar to FIG. 1 illustrating different stages in the operating cycle of the same device.
Figure 3:
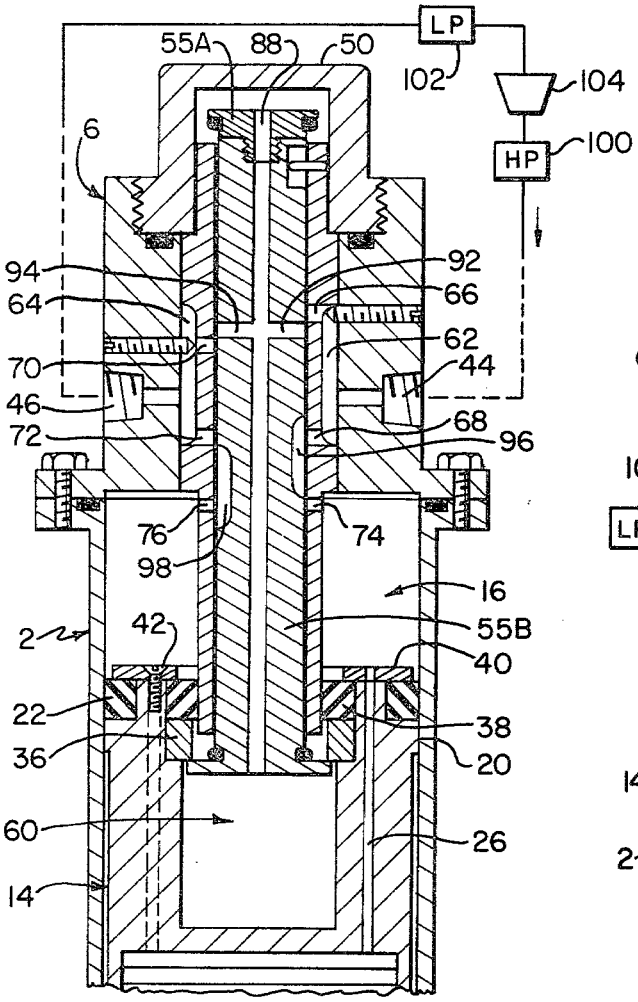

Referring now to FIGS. 1–3 the illustrated refrigeration apparatus is designed to operate in accordance with the Gifford-McMahon refrigeration cycle. The refrigerator is seen as comprising an external housing 2 having an upper flange 4 by means of which it is joined to a header 6. A bottom flange 8 on the header 6 is secured to the flange 4 by means of suitable screw fasteners 9. The refrigerator housing is closed on its lower colder end by a relatively thick end plate 10. If desired, a heat station in the form of a flanged tubular member 12 may be secured to the lower end of the housing wall. The end plate 10 and the heat station 12 are formed of a suitable metal, e.g., copper, which exhibits good thermal conductivity at the cryogenic temperatures produced by the system, with the end plate and the heat station being in heat exchange relationship with the cold fluid within the refrigerator so as to extract heat therefrom. The heat station may take other forms as, for example, coils surrounding the bottom end of the housing 2 or, as disclosed in U.S. Pat. No. 2,966,034, the refrigeration available at the lower end of the housing 2 may be used for the cooling of an infrared detector attached to the end wall 10.

A displacer 14 moves within the housing to define an upper warm chamber 16 of variable volume and a lower cold expansion chamber 18 of variable volume. A sliding fluid seal is formed between the upper section 20 of the displacer and the inner surface of the refrigerator housing 2 by a resilient sealing ring 22 which is mounted in a groove in the displacer. The lower section 23 of the displacer makes a sliding fit with the refrigerator housing but no effort need be made to provide a fluid seal between them.

Chambers 16 and 18 are in fluid communication through a fluid flow path which contains suitable heat-storage means. More specifically, the fluid path flow comprises a regenerator 24 which is located within the displacer 14 and one or more conduits or passageways 26 in the displacer which lead from the upper section of the regenerator to the chamber 16. The fluid flow path also includes pathways in the regenerator itself, a series of radial passages 28 formed in the lower displacer wall 32, and an annular passage 30 between the lower displacer wall and the inner surface of the housing 2. In accordance with known practice, the matrix of the regenerator may be formed of packed lead balls, fine metal screening, metal wire segments, or any other suitable heat high storage material affording low resistance pathways for gas flow. The exact construction of the regenerator may be varied substantially without affecting the mode of operation of the invention. Lower displacer wall 32 is formed of a metal having good thermal conductivity at the temperature produced in cold chamber 18.

The upper end of displacer 14 is formed with a coaxial bore 34 of circular cross section. The bore is enlarged at its upper end so as to form a shoulder against which is secured an annular metal ring 36. A resilient ring seal 38 is mounted in the upper end of the counterbore so as to provide a sliding fluid seal between the displacer and the confronting portion of the valve assembly hereinafter described. A plate 40 is secured to the upper end of the displacer by means of suitable fasteners 42. The plate 40 serves to assist in captivating seals 22 and 38.

The header 6 is provided with a first "HI" port 44 for the introduction of high pressure fluid to the refrigerator and a second "LO" port 46 for use in exhausting the low pressure fluid. By way of example, the fluid is helium gas. The header has a cylindrical coaxial bore 48 with an enlarged threaded section at its top end which is closed off by a threaded cap member 50. The bore 48 accommodates the valving mechanism which consists of a valve casing 52 and a valve member 54. The casing 52 has an enlarged diameter section 55 which makes a close fit within the bore 48, a reduced diameter upper section 57 which extends into the cap 50 and a reduced diameter bottom section 59 which extends into the axial bore 34 formed in the upper end of the displacer. The valve casing 52 is secured to the header 6 by suitable means, e.g. by a friction fit or a roll pin or a threaded connection, so that the valve casing is fixed with respect to the housing 2. The seal 38 engages the lower end 59 of the valve casing and forms a sliding fluid seal between the valve casing and the displacer, whereby a driving chamber 60 of variable volume is formed between the two members. Chamber 60 is hereinafter termed the "driving chamber", while chambers 16 and 18 are called the "warm" and "cold" chambers respectively.

Valve casing 52 is formed with two relatively long recesses 62 and 64 which are disposed so as to communicate with the ports 44 and 46 respectively. Additionally the valve casing comprises two radial passageways 66 and 68 which communicate with the opposite ends of recess 62, plus two additional radial ports 70 and 72 which communicate with recess 64.

In addition to the foregoing passageways, valve casing 52 has a pair of diametrically opposed radially extending ports 74 and 76 (see FIG. 2) which lead into the chamber 16.

The valve member 54 is sized to make a snug sliding fit within valve casing 52. Valve member 54 is provided with a peripheral flange 78 at its lower end which is sized so as to make a sliding fit with the displacer in the bore 34 and to intercept the ring 36 when the displacer is moved downwardly relative to valve casing 52 (FIG. 2). An O-ring 80 is mounted in a groove in the valve member against flange 78 in position to engage the lower end of valve casing 52 and thereby act as a snubber when the valve member moves upwardly in the valve casing. The upper end of valve member 54 is provided with a second peripheral flange 82 which acts as a shoulder for another O-ring 84 mounted in a groove formed in the valve member. O-ring 84 is arranged so that it will intercept the upper end of valve casing 52 and thereby act as a snubber for the valve member. The valve member is held against rotation by means of a pin 85 which is secured in a hole in valve casing 52 and extends into a vertically elongate narrow slot 86 in the valve member. The slot 86 and the pin 85 are sized so as to permit the valve member to move axially far enough for the O-rings 80 and 84 to engage the corresponding ends of the valve casing and thereby limit the travel of the valve member 54. However, if desired, the O-rings 80 and 84 may be omitted and the limit of travel of the valve member may be determined by engagement of the flanges 78 and 82 with the ends of the valve casing (provided the flanges are appropriately arranged to permit the valve member to function in the manner hereinafter described), or by engagement of pin 85 with the upper and lower ends of slot 86. To facilitate assembly and disassembly, valve member 54 is made in two parts 55A and 55B which are releasably secured together e.g., by a threaded connection as shown. The parts 55A and 55B may be locked to one another by suitable means, e.g. LOCTITE ®.

Still referring to FIGS. 1–3, valve member 54 has a center passageway 88 which is open at both ends, i.e., so that it communicates with the chamber 60 and also with the chamber 90 formed between the upper end of the valve member, the upper end of the valve casing, and the cap 50. Additionally valve member 54 has two aligned radially extending passageways 92 and 94 which intersect the center passageway 88, plus two axially extending slots or recesses 96 and 98 which are of identical length but are offset from one another lengthwise of the valve member. The passageways 92 and 94 are arranged so that passageway 92 will be aligned with port 66 when the valve member is in its upper limit position (FIG. 1) and passageway 94 will be aligned with port 79 when the valve member is in its lower limit position (FIG. 2). The recesses 96 and 98 are arranged so that when the valve member is in its upper limit position, recess 96 will communicate with passageway 68 but will be blocked off from port 74 by the confronting inner surface of the valve casing, while recess 98 will provide full communication between ports 72 and 76. Additionally when the valve member is in its lower limit position, recess 96 provides full communication between ports 68 and 74 and simultaneously recess 98 will communicate with the port 76 but otherwise will be blocked off from port 72 by the confronting inner surface of the valve casing, all as shown in FIGS. 1 and 2. Additionally the valve is arranged so that the valve member 54 may achieve an intermediate transition position (FIG. 3) in which both of the HI and LO pressure ports 44 and 46 are effectively isolated from chamber 16. Because of its capability of assuming this transition position, the valve may be locked upon as a three-state valve, i.e. capable of closing off ports 74 and 76 alternatively or simultaneously. It is desirable that the transition position be narrow so as to achieve a rapid switching of the HI and LO ports connections to chamber 16. Accordingly the valve is made so that in the transition position the lower end edge of recess 96 is even with the upper edge of port 74 and the upper end edge of recess 98 is even with the lower edge of port 72, and also the upper edge of passageway 92 is even with the lower edge of port 66 and the lower edge of passageway 94 is even with the upper edge of port 70, with the result that in the transition position chamber 16 is cut off from the HI and LO ports but only a slight movement of valve member 54 up or down is required to connect HI port 44 or LO port 46 to chamber 16. In practice, however, when the valve is in its transition position some leakage of fluid tends to occur between (a) passages 74 and 68, (b) passages 76 and 72, (c) passages 66 and 92 and passages 70 and 94, due to clearances required to allow the member 54 to slide in casing 52 and also possibly due to imperfect formation and/or location of the various ports and passageways in the slide valve.

In the usual installation, the refrigerator of FIGS. 1–3 will have its port 44 connected to a reservoir or source of high pressure fluid 100 and its port 46 connected to a reservoir or source of low pressure fluid 102. It will, of course, be understood that the lower pressure fluid may exhaust to the atmosphere (open cycle) or may be returned to the system (closed cycle) by way of suitable conduits which lead first into a compressor 104 and then into the high pressure reservoir 100, in the manner illustrated in FIG. 1 of U.S. Pat. No. 2,966,035.

The operation of the apparatus illustrated in FIGS. 1–3 is explained starting with the assumption that slide valve member 54 is in its bottom limit position (FIG. 2) and displacer 14 is moving upward and is now just short of its top dead center position (TDC) at the point where it first engages the bottom end of slide valve member 54. At this point the fluid pressure and temperature conditions in the refrigerator are as follows: chamber 16—high pressure and room temperature; chamber 18—high pressure and low temperature; chambers 60 and 90—low pressure and room temperature. As the displacer continues moving up, its surface 35 engages slide valve member 54 and shifts the latter up through its transition point until it reaches its top limit position (FIG. 1) and the displacer reaches its top dead center position. When the slide valve member passes its transition position, fluid commences to exhaust from chamber 16 via passages 64, 72, 98 and 76, thus reducing the pressure in chambers 16 and 18; simultaneously the low pressure in chambers 60 and 90 starts to increase as a consequence of high pressure air entering via passages 44, 62, 66, 92 and 88. With the slide valve in its upper limit position, and the displacer in its TDC position, cold high pressure gas in chamber 18 will exhaust through the regenerator and as it does it gets heated up by the regenerator matrix. Now because of the increasing pressure in chamber 60 and the lower pressure in chambers 16 and 18, a differential force is exerted on the displacer, causing it to move down and displace gas from chamber 18 to chamber 16. However, as the displacer starts down, valve member 54 will remain in its top limit position. Thus, as the displacer moves down the valve will continue to exhaust low pressure gas from chamber 16, and the regenerator cools down further as it gives up heat to the remainder of the cold gas displaced from chamber 18. The cold gas flowing out through the regenerator expands on heating, thus cooling the regenerator further.

As the displacer nears its bottom dead center position (BDC), it intercepts slide valve member 54 and moves it down through its transition position to its bottom limit position (FIG. 2). The displacer goes to and stops at its BDC position. When the valve member passes its transition position, fluid commences to exhaust from chambers 60 and 90 via passages 88, 94, 64, and 46 so that the pressure in those chambers drops; simultaneously high pressure fluid will flow into chamber 16 via passages 44, 62, 68, 96 and 74, thus causing chamber 16 to be filled with high pressure, low temperature gas which flows into chamber 18 and gets cooled as it passes through the regenerator. The increasing pressure in chambers 16 and 18 coupled with the lower pressure in chambers 60 and 90 produces a pressure differential across the displacer sufficient to cause it to start moving up again. As the displacer moves up it forces more high pressure, room temperature gas from chamber 16 through the regenerator to chamber 18, thus cooling this additional gas and causing it to contract in volume. This reduction in volume allows more gas to be displaced from chamber 16 into chamber 18. The displacer continues moving up to its TDC position and as it does, it again encounters and shifts the slide valve member to its top limit position, thus causing the cycle of operation first described to be repeated. It should be noted that as the displacer reaches its TDC position, the system will have cold high pressure gas in chamber 18, room temperature low pressure gas in chamber 60 and room temperature high pressure gas in chamber 16.

The speed of operation of the refrigerator of FIGS. 1–3 is controlled by the rate at which the pressure in drive volume 60 is switched between the HI and LO pressures at ports 44 and 46. Accordingly screw-type needle valves are provided in header 6 as shown at 106 and 108 to adjust the effective orifice size of passages 66 and 70 respectively. The outer ends of the needle valves are provided with kerfs to receive a screwdriver for turning them so as to permit adjustment of the flow rates while the unit is in operation.

The foregoing mode of operation assumes that the displacer has enough inertia to move the slide valve through its transition point so as to achieve continuous operation. However, the particular valve construction used in the device of FIGS. 1–3 is handicapped somewhat by the fact that the valve member is subject to a radial force as a consequence of the difference between the fluid pressure seen by the valve member at passages 66, 68 (HI) and 70, 72 (LO). This radial force exerts a drag on the valve member. If the device is operated at a relatively high speed, e.g. 20 cycles per second, the displacer will have sufficient inertia to overcome the drag force and carry the slide member rapidly through its transition point. However, if the displacer speed is sufficiently reduced, e.g., 3 cycles per second, the inertia may be insufficient and the drag force may cause the valve unit to move slow enough to stop at or near its transition point, with the possible result that the displacer may achieve equilibrium and stop due to an inadequate pressure differential across it. The minimum speed required to insure continuous reciprocating movement of the displacer will vary according to the drag which must be overcome.

In this connection it is to be understood as mentioned earlier that when the above-described slide valve member is in its transition (FIG. 3) a small leakage of fluid tends to occur at various ports in the valve. Thus, when the displacer is in the process of moving up from the position of FIG. 2 to the position of FIG. 1 and has proceeded far enough to shift slide valve member 54 up to the transition position of FIG. 3, leakage may occur between passages 72 and 76 and also between passages 66 and 92, with the result that the high pressure fluid in chambers 16 and 18 will begin to exhaust via port 46 and the low pressure in chamber 60 will start to incrrease due to influx of high pressure fluid via port 44. As a consequence the pressures in chamber 16 and 60 will become equal and the displacer will stop moving unless it has enough inertia to drive the slide valve member out of its transition position to the position shown in FIG. 1, in which event the displacer will be subjected to a pressure differential that will force it to move back down in a continuance of its operating cycle. At this point it is to be appreciated that the pneumatic force acting on the displacer is the difference between the product of the pressure in chamber 60 and the area of its surface 35, and the product of the pressure in chamber 18 and the corresponding area of the undersurface of end wall 32, since the effect of the pressure in chamber 18 acting on the remaining area of the undersurface of end wall 32 and the exposed undersurface 25 of the lower section 23 of the displacer, is cancelled by the effect of the identical pressure in chamber 16 acting on the effective upper end area of the displacer, i.e. the effective area of the upper surfaces of plate 40 and seals 22 and 38. Similarly, when the displacer is in the process of moving down from the position of FIG. 1 to that of FIG. 2 and has proceeded far enough to shift slide valve member 34 back down to its transition position, leakage may occur between passages 68 and 74 and also between passages 64 and 94, with the result that the pressure in chambers 16 and 18 will commence to increase due to inflow of high pressure gas, and the high pressure fluid in chambers 60 and 90 will commence to exhaust. As a consequence the pressures in chambers 16 and 60 again become equal and equilibrium may occur again, i.e. displacer 14 may stop, unless the displacer has enough inertia to propel the slide valve member to its bottom limit position, at which point the pressures will change rapidly with chamber 60 and 90 being fully exhausted to the LO pressure level and chambers 16 and 18 being fully pressurized to the HI pressure level.

In practice devices having the form of slide valve shown in FIGS. 1–3 are operated at speeds which are just high enough to overcome the drag force so as to assure continuous operation, yet low enough to maximize cooling efficiency. A preferred operating speed for this form of device is about 10 Hz, although higher and lower speeds are possible. Typically the devices will operate continuously when operated at about 8 Hz or more but tend to stop when throttled down to about 5 Hz or less. At speeds between about 5 Hz and 8 Hz continuous operation is less reliable than at higher speeds. This low operating speed limitation is offset by the relatively low cost and simplicity of the slide valve assembly.

Figure 4:
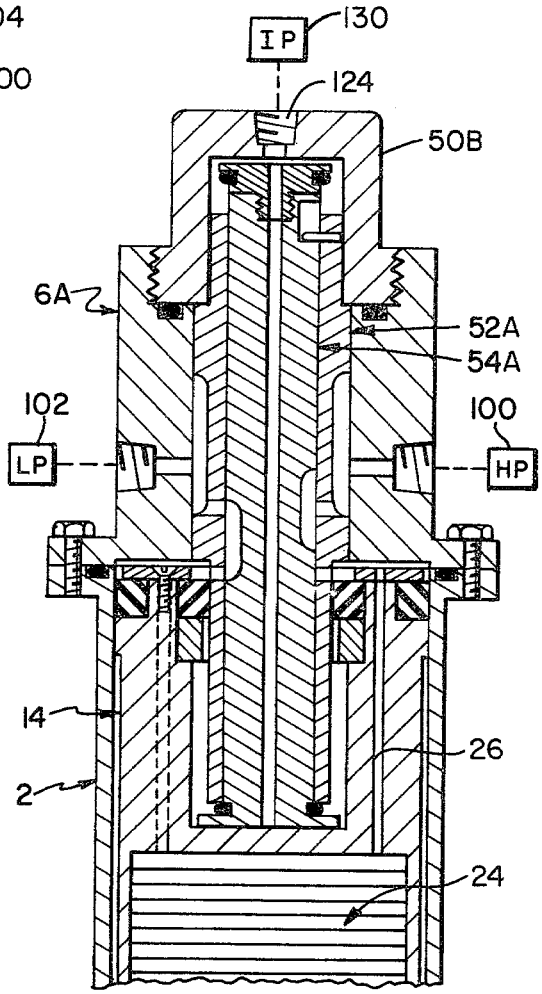
FIG. 4 is a fragmentary sectional view illustrating a modification of the embodiments of FIGS. 1–3.

FIG. 4 illustrates another embodiment of the invention. FIG. 4 is similar to FIG. 1 but differs in certain respects. First of all, it has a header 6A which is like header 6 except that it lacks passages 66 and 70 and needle valves 106 and 108. Also it has a cap 50A which differs from cap 50 in that it includes a port 124 which communicates with the central passageway 88 of the slide valve member. Also it uses a valve casing 52A which lacks passages 66 and 70 and a valve member 54A which lacks passages 92 and 94. Port 124 is connected to an intermediate pressure source 130 while ports 44 and 46 are connected to the HI and LO sources 100 and 102 respectively. Source 130 is at an intermediate pressure IP which preferably is halfway between pressures of the LO and HI pressure gases. This device operates like that of FIGS. 1–3 except that the intermediate pressure has the effect of reducing the magnitude of the pressure differential which causes reciprocation of the displacer since the pressure in chamber 60 stays constant instead of fluctuating between HI and LO.

Figure 5:
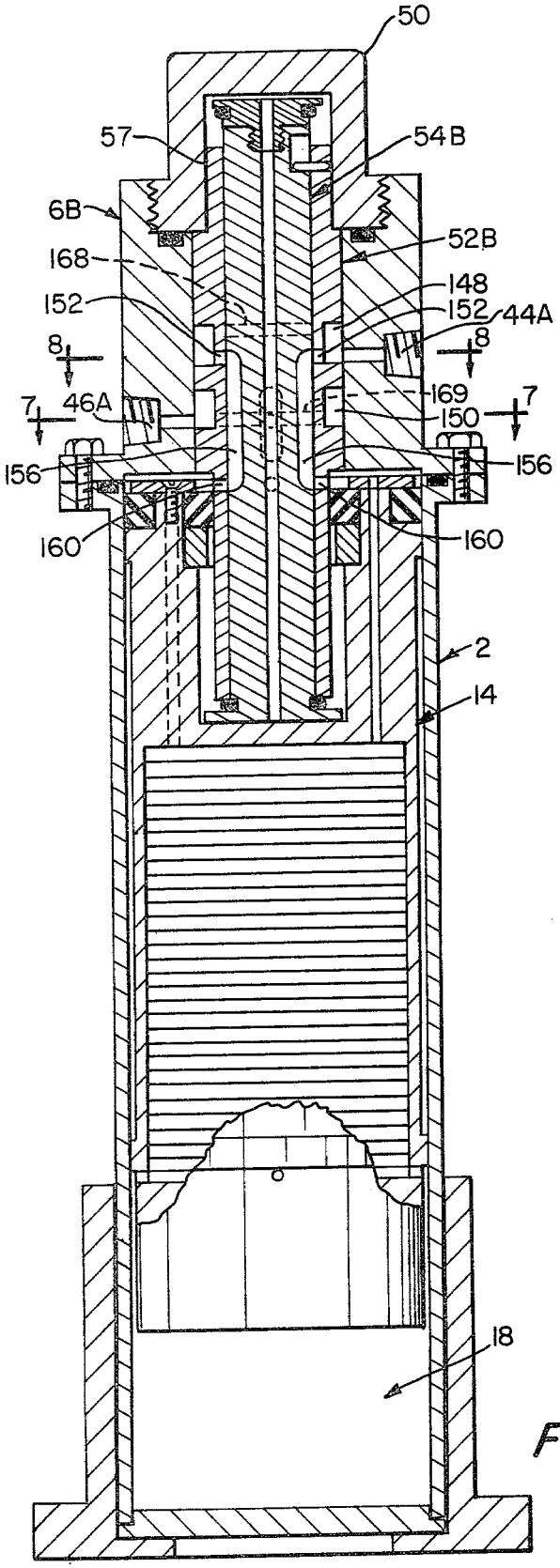
FIG. 5 is a sectional view of a preferred form of self-regulating refrigerator which is similar to that of FIG. 1 but employs a preferred form of slide valve for controlling refrigerant flow.
Figure 6:
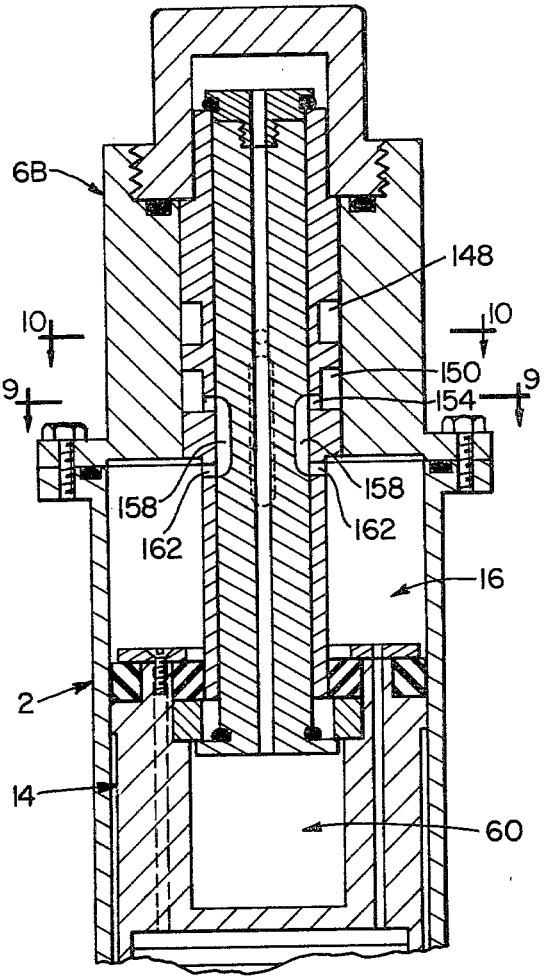
FIG. 6 is a fragmentary view of the device of FIG. 5 displaced ninety degrees from the viewpoint of FIG. 7.
Figure 7:
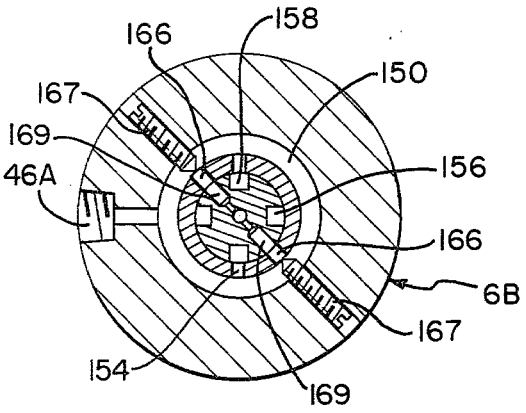
FIGS. 7 and 8 are cross-sectional views taken along the lines 7—7 and 8—8 respectively in FIG. 5.
Figure 9:
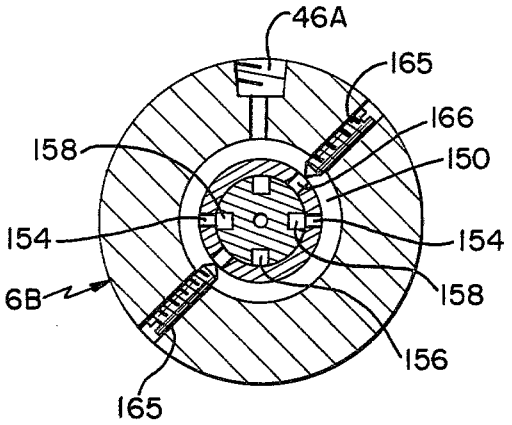
FIGS. 9 and 10 are cross-sectional views of the same device shown taken along the lines 9—9 and 10—10 respectively in FIG. 6.
Figure 8:
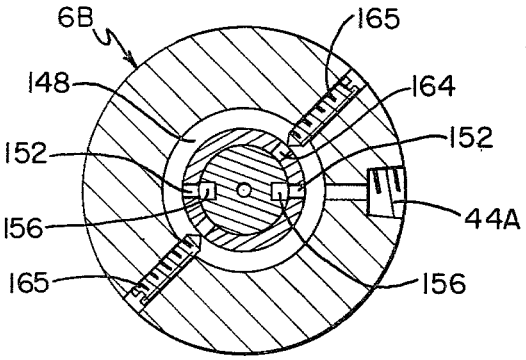
Figure 10:
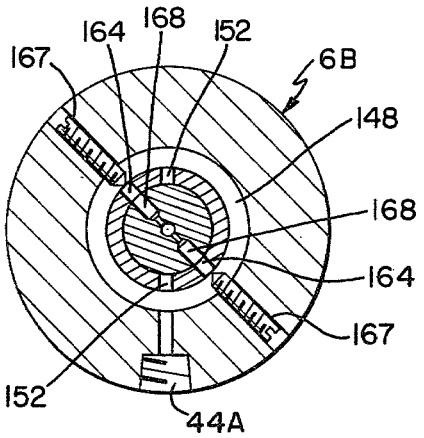

The way to overcome the tendency of the displacer coming to a stop at low operating frequencies is to utilize an improved form of slide valve which eliminates the drag problem of the valve shown in FIG. 1–3. The improved form of slide valve, which is the subject of a copending U.S. application filed by Calvin Lam and me and owned by the assignee of this application, is embodied in the device shown in FIGS. 5–10. Referring now to FIGS. 5–10, the device shown therein is the same as the device of FIGS. 1–3 except as otherwise stated hereinafter. The header 6B has two ports 44A and 46A which are offset from one another along the axis of the device and are adapted for connection to the LO and HI pressure sources 102 and 100 respectively. This improved slide valve consists of a valve casing 52B having two peripheral grooves 148 and 150 which connect with ports 44A and 46A respectively and serve as manifold chambers. Valve casing 52B is provided with a pair of diametrically opposed ports 152 intersecting groove 148 and a second pair of like ports 154 intersecting groove 150. Ports 154 are displaced ninety degrees from ports 152. Valve member 54B also is provided with a pair of narrow relatively long, diametrically opposed recesses 156 which have a length which is just sufficient to allow their upper ends to register exactly with ports 152 when their bottom ends are in exact registration with a pair of diametrically opposed ports 160 that are formed in valve casing 52C and are located just below the header so as to communicate with chamber 16. Valve member 54B has a second pair of narrow relatively short, diametrically opposed recesses 158 which have a length just sufficient to allow their upper ends to register exactly with ports 154 when their lower ends are in exact registration with a pair of diametrically opposed ports 162 formed in valve casing 52B at the same level as but displaced ninety degrees from ports 160. The recesses 156 and 158 are arranged so that the ends of recesses 158 are blocked by the valve casing and recesses 156 are in complete registration with ports 152 and 160 when the slide valve member is in its upper limit position (FIG. 5). Similarly the ends of recesses 156 are blocked by casing 52B and recesses 158 are in complete registration with ports 154 and 162 when the slide valve member is n its lower limit position (FIG. 6). The foregoing ports and recesses also are arranged so that the valve has an intermediate transition point where, except for leakage due to necessary clearances and imperfect formation of the ports and recesses, as previously described, fluid flow between ports 162 and 46A and between ports 160 and 44A is terminated. This transition point occurs when the upper edges of recesses 156 are even with the lower edges of ports 152 and the lower edge of recesses 158 are even with the upper edges of ports 162.

The slide valve casing of FIGS. 5–10 also is characterized by two pairs of diametrically opposed ports 164 and 166 (FIGS. 8 and 7) which intersect grooves 148 and 150 but are displaced circumferentially from ports 152 and 154 respectively. Ports 164 and 166 preferably are displaced 45° from ports 152 and 154 respectively about the center axis of the valve. A pair of screw-type needle valves 165 and 167 in header 6B coact with ports 164 and 166 respectively to vary the rate of flow of fluid through those ports. In addition slide valve member 54B has two pairs of diametrically opposed ports 168 and 169 which intersect its center passage 88. Ports 168 and 164 lie in a first common plane extending along the center axis of the valve, and ports 169 and 166 lie in a second like plane. The axial spacing between ports 168 and 169 is such that when the slide valve member is in its upper limit position (FIG. 5), ports 168 will be out of registration with ports 164 (FIG. 8) and blocked by casing 52C, and ports 169 will be in registration with ports 166 (FIG. 7); similarly when the valve member shifts to its lower limit position (FIG. 6), ports 168 will be in registration with ports 164 (FIG. 10) and ports 169 will be out of registration with ports 166 (FIG. 9) and blocked by casing 52C.

Thus when the valve is in its upper limit position, port 44A will be connected to chamber 16 and port 46A will be connected via passage 88 to chamber 60. In the down valve position, chamber 16 is connected to port 46A and chamber 60 is connected to port 44A. Consequently the mode of operation of the refrigerator of FIGS. 5–10 is similar to that of FIGS. 1–3 except that when the slide valve is in its upper limit position the chamber 16 is connected to low prressure source 102 via port 44A, and when the valve is in its lower limit position port 46A connects chamber 16 to high pressure source 100. More importantly it can operate suitably at low speeds, e.g. displacer 14 can separate at a frequency of 2–5 Hz without stopping due to establishment of an equilibrium position. This is due to the fact that the slide valve member is subjected to exactly opposing fluid pressures at opposed ports 152, and also at opposed ports 154, 164 and 166. Hence there is no pressure differential on the slide valve acting to create a drag force. Also should any fluid tend to leak between slide valve member 54B and into casing 52B, an intervening layer of fluid would tend to be established between those members having the effect of further reducing the drag force, i.e. a condition similar to an air bearing. A further advantage of the system of FIGS. 5–10 is that the operating speed of the displacer can be adjusted simply by varying the settings of needle valves 165 and 167 (assuming substantially constant pressures at the LO and HI pressure ports 44A and 46A. The cryogenic refrigeration cycle of this device involves the same steps as the operation cycle of the device of FIGS. 1–3.

The foregoing embodiments of the invention are capable of carrying out the Gifford-McMahon cycle and persons skilled in the art will appreciate that the invention is susceptible of other modifications made in contemplation of other known refrigeration cycles. The invention offers many advantages, including but not limited to the ability to control displacer speed, adaptability to different sizes and capacities, compatibility with existing cryogenic technology (e.g., use of conventional regenerators), the simplicity, ease of removal and reliability of the slide valves, the ability to scale up displacer size without having to proportionally increase the diameter or length of the slide valve, a relatively short slide valve stroke, and the ability to eliminate banging of the displacer and slide valve. By way of example, the slide valve stroke between its two limit positions may be only ⅛ inch. The O-rings 80 and 84 cushion the slide valve to reduce noise and the slide valve operates at ambient temperature even while the lower end of cylinder 2 is at temperatures as low as 110° K. to 14° K. A further advantage of the invention is that the device may be made with the regenerator external of the displacer according to prior practice, or with two or more similar refrigeration stages in series as shown, for example, U.S. Pat. Nos. 3,188,818 and 3,218,815, or with auxiliary refrigeration stages employing one or more Joule-Thomson heat exchangers and expansion valves as shown by prior art herein referred to. Preferably but not necessarily the ports 66, 68, 74 and 76 and passages 92 and 94 are all round and have the same diameter, and passages 96 and 98 have the same effective cross-sectional area. The same design restrictions are preferred for corresponding portions of the device of FIGS. 5–10. Other advantages and modifications will be obvious to persons skilled in the art.

What is claimed is:

1. In a cryogenic refrigerator in which a movable displacer means defines within an enclosure first and second chambers of variable volume, and in which a refrigerant fluid is circulated in a fluid flow path between said first chamber and said second chamber by the movement of said displacer means controlled through the introduction of high-pressure fluid and the discharge of low-pressure fluid, the improvement comprising a fluidic driving means for the displacer means which comprises in combination;

a valve comprising a valve casing and a valve member, and means mounting said valve casing in fixed relation to said enclosure, said valve casing having a high-pressure inlet port, a low-pressure outlet port, and at least one transfer port which communicates with said first chamber of variable volume, and said valve member being movable bidirectionally relative to said casing and having first and second passages arranged so as to alternately connect said inlet and outlet ports to said transfer port according to the position of said valve member.

2. A refrigerator according to claim 1 wherein said valve member is movable bidirectionally by said displacer means and said displacer means is capable of limited movement independently of said valve member so as to permit transfer of a substantial amount of fluid in a given direction as a result of displacement by said displacer means before causing said valve member to reverse the fluid flow connections between said inlet and outlet ports and said transfer port.

3. A refrigerator in accordance with claim 1 wherein said first chamber surrounds a portion of said valve.

4. A refrigerator in accordance with claim 1 wherein said displacer means is in telescoping relation with at least a portion of said valve.

5. A refrigerator in accordance with claim 4 wherein said movable valve member intrudes into an intermediate chamber of variable volume defined by said displacer means and is engageable with said displacer means, and said valve comprises conduit means arranged so as to alternately connect said outlet and inlet ports to said intermediate chamber according to the position of the valve member.

6. A refrigerator in accordance with claim 4 wherein said movable valve member intrudes into an intermediate chamber of variable volume defined by said displacer means and is engageable with said displacer means, and said valve comprises conduit means arranged so as to alternately connect said outlet and inlet ports to said intermediate chamber according to the position of the valve member.

7. A refrigerator in accordance with claim 1 wherein said valve member protrudes from one end of said valve casing and is engageable with said displacer means.

8. A refrigerator in accordance with claim 7 wherein said enclosure comprises a cylindrical housing in which said displacer means is slidably disposed, and further wherein said valve casing is fixed to said housing.

9. A refrigerator in accordance with claim 8 having a header affixed to said housing and supporting said valve casing, said header including first and second ports for connecting said inlet and outlet ports respectively to high pressure and low pressure reservoirs respectively.

10. A refrigerator according to claim 8 further including high pressure and low pressure reservoirs connected to said first and second ports respectively, and a compressor connected for compressing fluid flowing from said low pressure reservoir and delivering the compressed fluid to the high pressure reservoir.

11. A refrigerator according to claim 7 wherein said valve member and said displacer means are provided with (a) first and second mutually confronting means respectively for causing said valve member to be engaged and shifted by said displacer means as the displacer means moves in a first direction, and (b) third and fourth mutually confronting means respectively for causing said valve member to be engaged and shifted by said displacer means as the displacer means moves in a second opposite direction.

12. A refrigerator according to claim 11 wherein said valve member is shifted by said displacer means in the direction of movement of the displacer means.

13. A refrigerator according to claim 1 having regenerator means for exchanging heat with the fluid transferred by the displacer means.

14. A refrigerator according to claim 12 wherein the regenerator means is embodied in the displacer means.

15. A refrigerator according to claim 1 further including means operable independently of said valve for adjusting the rate of flow of fluid so as to control the rate of movement of the displacer means.

16. A refrigerator according to claim 1 wherein said valve member is slidably mounted for reciprocal motion in said valve casing, one end of said valve member protrudes into a third variable volume chamber defined by said valve casing and said displacer means, a fourth variable volume chamber is formed by means cooperating with the opposite end of the valve member and the valve casing, and the valve member includes a passageway for equalizing the pressure in said third and fourth variable volume chambers.

17. A refrigerator according to claim 16 further including a port in said valve casing for introducing a fluid at a selected pressure to at least one of said third and fourth variable volume chambers independently of the mode of fluid flow determined by the connections between the inlet and outlet ports and said at least one transfer port.

18. A refrigerator according to claim 16 further including a fluid seal between said valve casing and said displacer means so as to isolate said third chamber from said first chamber.

19. A refrigerator according to claim 1 wherein said valve member is slidable in the valve casing and comprises first and second means for (a) connecting said inlet port to said first chamber via said at least one transfer port when the valve member is in a first position and (b) connecting said outlet port to said first chamber via said at least one transfer port when said valve member is in a second position.

20. A refrigerator according to claim 19 wherein said enclosure comprises a header and a housing connected at one end to said header, said header having passageways for connecting said inlet and outlet ports to high pressure and low pressure lines, said valve casing being supported by said header, and said first and second chambers being formed by opposite ends of the displacer means and corresponding ends of the housing.

21. A refrigerator according to claim 20 wherein said valve casing and said displacer means are in telescoping relation with one another and said valve member is engaged by said displacer means at different positions of said displacer means and propelled thereby to one or other of its first and second positions as the displacer moves in a first direction or a second opposite direction respectively.

22. A refrigerator according to claim 20 further including means for recovering refrigeration from the second chamber.

23. A cryogenic refrigerator comprising:

cylinder means, displacer means movable within the cylinder means according to a four step sequence wherein it (a) dwells in an uppermost position, (b) moves downwardly, (c) dwells in a lowermost position and (d) moves upwardly again;

first and second chambers the volumes of which are defined by movement of the displacer means, conduit means connecting said first and second chambers, thermal storage means associated with said conduit means, supply reservoir means for supplying high pressure fluid, exhaust reservoir means for receiving low pressure fluid; and refrigerator regulating valve means associated with the supply and exhaust reservoir means for causing high pressure fluid to enter the first chamber and the conduit during the first-mentioned and second-mentioned steps of the displacer means motion and to exhaust low-pressure fluid during the third and fourth steps of the displacer means motion, said valve means comprising a valve casing fixed with respect to the cylinder means and a valve member slidable relative to the casing, the casing having inlet and outlet ports communicating with said supply reservoir means and said exhaust reservoir means respectively, said valve casing and valve member also having cooperating means for alternately connecting said first chamber to one of said inlet and outlet ports while simultaneously disconnecting it from the other of said inlet and outlet ports according to the movement of the valve member between two limit positions, and cooperating means on the displacer means and valve member for (a) causing the valve member to be in one of its limit positions and the displacer means to be in its uppermost position concurrently, and (b) causing the valve member to be in its other limit position and the displacer means to be in its lowermost position concurrently.

24. In a cryogenic refrigerator in which (1) a reciprocable displacer means defines within an enclosure first and second chambers of a variable volume, (2) a fluid under pressure is circulated in a fluid flow path between said first and second chambers by the movement of said displacer means, (3) the fluid flow path includes a regenerator for exchanging heat between fluid entering and leaving said second chamber, and (4) the displacer means is reciprocated by a varying differential pressure between the pressure in said second chamber and a restoring pressure, the improvement comprising a fluidic driving means for the displacer means which comprises in combination:

a valve comprising a valve casing and a valve member, said valve casing being fixed with respect to said enclosure and having a high-pressure inlet port, a low-pressure outlet port, and at least one transfer port which communicates with said first chamber, and said valve member being movable bidirectionally relative to said casing by said displacer means and having first and second passages arranged so as to alternately connect said inlet and outlet ports to said transfer port according to the position of said valve member.

25. A refrigerator according to claim 24 wherein said displacer means is capable of limited movement independently of said valve member so as to permit transfer of a substantial amount of fluid in a given direction as a result of displacement by said displacer means before causing said valve member to reverse the fluid flow connections between said inlet and outlet ports and said transfer port.

26. A refrigerator in accordance with claim 24 wherein said first chamber surrounds a portion of said valve.

27. A refrigerator in accordance with claim 24 wherein said displacer means is coaxial with said valve.

28. A refrigerator in accordance with claim 24 wherein said valve member protrudes from one end of said valve casing and is engageable with said displacer means.

29. A refrigerator according to claim 28 wherein said valve member and said displacer means are provided with (a) first and second mutually confronting means respectively for causing said valve member to be engaged and shifted by said displacer means as the displacer means moves in a first direction, and (b) third and fourth mutually confronting means respectively for causing said valve member to be engaged and shifted by said displacer means as the displacer means moves in a second opposite direction.

30. A refrigerator in accordance with claim 24 wherein said enclosure is a metal housing, and further including a header affixed to said housing and supporting said valve casing, said header including first and second ports for connecting said inlet and outlet ports respectively to high pressure and low pressure reservoirs respectively.

31. A refrigerator according to claim 30 further including high pressure and low pressure reservoirs connected to said first and second ports respectively, and a compressor connected for compressing fluid flowing from said low pressure reservoir and delivering the compressed fluid to the high pressure reservoir.

32. A refrigerator according to claim 24 further including means operable independently of said valve for adjusting the rate of flow of fluid so as to control the rate of movement of the displacer means.

33. A refrigerator according to claim 32 wherein said regenerator is embodied in the displacer means.

34. A refrigerator according to claim 24 wherein said valve member is slidably mounted for reciprocal motion in said valve casing, one end of said valve member protrudes into a third variable volume chamber defined by said valve casing and said displacer means, a fourth variable volume chamber is formed by means cooperating with the opposite end of the valve member and the valve casing, and the valve member includes a passageway for equalizing the pressure in said third and fourth variable volume chambers.

35. A refrigerator according to claim 34 further including a port in said valve casing for introducing a fluid at a selected pressure to at least one of said third and fourth variable volume chambers independently of the mode of fluid flow determined by the connections between the inlet and outlet ports and said at least one transfer port.

36. A refrigerator according to claim 35 further including a fluid seal between said valve casing and said displacer means so as to isolate said third chamber from said first chamber.

37. A refrigerator according to claim 24 wherein said valve casing and said displacer means are in telescoping relation with one another and said valve member is engaged by said displacer means at different positions of said displacer means and propelled thereby to one or the other of its first and second positions as the displacer moves in a first direction or a second opposite direction respectively.

38. A refrigerator according to claim 37 further including means for recovering refrigeration from the second chamber.

39. A cryogenic refrigerant comprising:

cylinder means, displacer means reciprocally movable within said cylinder means;

first and second chambers in said cylinder means, with the volumes of said chambers varying with movement of said displacer means, conduit means connecting said first and second chambers, thermal storage means associated with said conduit means, supply reservoir means for supplying high pressure fluid;

exhaust reservoir means for receiving low pressure fluid; and refrigerator regulating valve means associated with the supply and exhaust reservoir means for causing high pressure fluid to enter the first chamber and the conduit means during a predetermined portion of the displacer means reciprocal stroke and for causing low-pressure fluid to be exhausted during the remaining portion of the displacer means stroke, said valve means comprising a valve casing fixed with respect to the cylinder means and a valve member slidable relative to the casing, the casing having inlet and outlet ports communicating with said supply reservoir means and said exhaust reservoir means respectively, said valve casing and valve member also having cooperating means for alternately connecting said first chamber to one of said inlet and outlet ports while simultaneously disconnecting it from the other of said inlet and outlet ports according to the movement of the valve member between two limits positions, and cooperating means on the displacer means and valve member for (a) causing the valve member to be in one of its limit positions and the displacer means to be in its uppermost position concurrently, and (b) causing the valve member to be in its other limit position and the displacer means to be in its lowermost position concurrently.

* * * * *